United States Patent [19]

Brown

[11] Patent Number: 4,462,599

[45] Date of Patent: Jul. 31, 1984

[54] SOCCER PRACTICE DEVICE

[76] Inventor: Ralph Brown, c/o Melvin Clark, 4234 Interlake Ave. N., Seattle, Wash. 98103

[21] Appl. No.: 537,998

[22] Filed: Sep. 30, 1983

[51] Int. Cl.[3] ..... A63B 69/00

[52] U.S. Cl. ..... 273/411; 273/58 C; 273/413

[58] Field of Search ..... 273/413, 411, 58 C, 273/26 E, 26 EA, 29 A

[56] References Cited

U.S. PATENT DOCUMENTS

| | | | |
|---|---|---|---|
| 2,772,882 | 12/1956 | Anson | 273/26 E |
| 3,262,703 | 7/1966 | Hodlick | 273/413 |
| 4,158,458 | 6/1979 | Gomez | 273/413 |
| 4,191,372 | 3/1980 | Keller | 273/29 A |
| 4,296,925 | 10/1981 | Alston | 273/413 X |

FOREIGN PATENT DOCUMENTS

| | | | |
|---|---|---|---|
| 2508922 | 9/1976 | Fed. Rep. of Germany | 273/411 |

*Primary Examiner*—William H. Grieb

*Attorney, Agent, or Firm*—Ward Brown; Robert W. Beach

[57] ABSTRACT

A soccer ball is suspended by a line from a horizontal arm cantilevered from an upright standard supported by a portable base. The height of the soccer ball can be adjusted by paying out or hauling in the appropriate length of line, and the line can be anchored to a cleat carried by the standard. The height of the ball is adjusted for a soccer player for instruction and practice of heading the ball. The standard is of knockdown construction for ease in transportation to a training site.

3 Claims, 4 Drawing Figures

SOCCER PRACTICE DEVICE

BACKGROUND OF THE INVENTION

1. Field of the Invention

The present invention relates to a training device for practicing soccer skills. More specifically, the present invention relates to a training device used in teaching and practicing heading techniques.

2. Prior Art

Fear of heading a soccer ball is common among inexperienced or young players. In the past, heading has been taught by explanation and demonstration of the proper techniques, followed by the teacher or coach tossing a soccer ball at a practicing player who attempts to head the ball. This method can increase the player's fear and reinforce improper techniques such as attempting to head the ball with the top of the head.

For other sports, training devices are known which assist in development of effective techniques, such as the "Jump Trainer" for basketball and volleyball practice of Alston U.S. Pat. No. 4,296,925 and the "Ball Holder" for baseball practice of Anson U.S. Pat. No. 2,772,882.

No device is known, however, for training a soccer player in effective and safe heading techniques.

SUMMARY OF THE INVENTION

The principal object of the present invention is to provide a device for use in training soccer players in effective and safe heading techniques.

It also is an object of the present invention to provide such a device which is of simple, inexpensive construction.

Another object is to provide such a device in lightweight form that can be disassembled quickly and easily for transportation to a training site, such as in the trunk of an automobile.

A further object is to provide such a device which, in use, will decrease the fear of inexperienced players to heading a soccer ball.

The foregoing objects can be accomplished by providing a training device having a soccer ball suspended by a line from a horizontal arm cantilevered from an upright standard. In the preferred embodiment of the invention, the standard is formed by a plurality of tubular sections, the bottom section being fitted in a portable base. Each succeeding upper standard section has a bottom end portion of reduced diameter fitted in the upper end portion of the next lower section. The connection between adjacent standard sections, and the connection between the bottom standard section and the base, deter rotation of the standard relative to the base. The horizontal arm from which the soccer ball is suspended is bent horizontally outward from the top standard section, and the line suspending the soccer ball passes over a pulley carried inside the horizontal arm, then through guide eyes projecting from the arm and the standard. The height of the soccer ball can be adjusted by hauling in or paying out the line, and the line can be anchored to a cleat carried by the standard.

DETAILED DESCRIPTION

Figure 1:
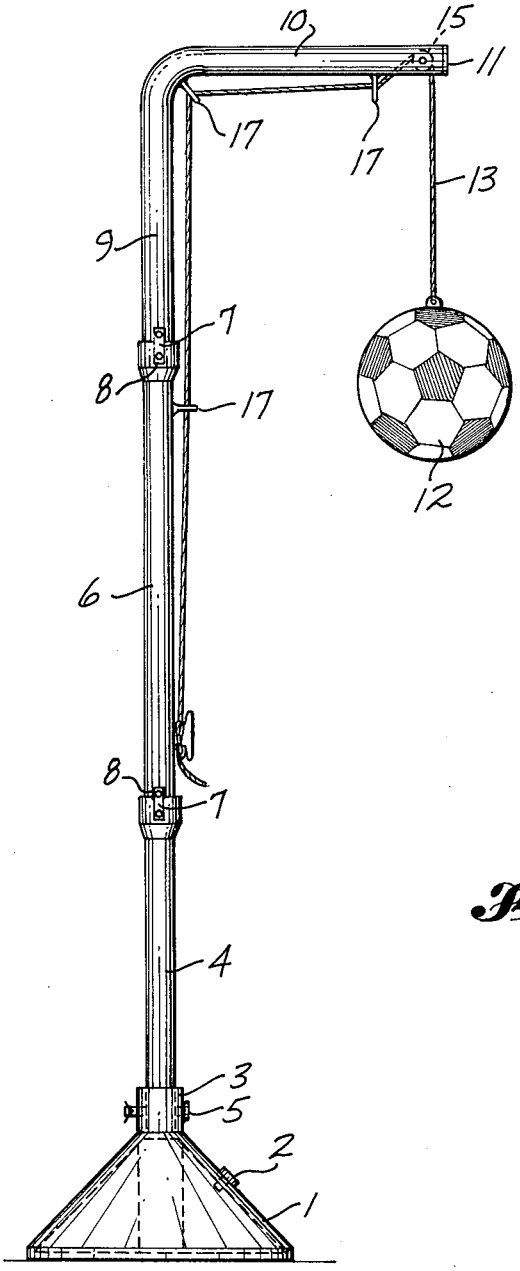
FIG. 1 is a side elevation of a soccer practice device in accordance with the present invention.
Figure 4:
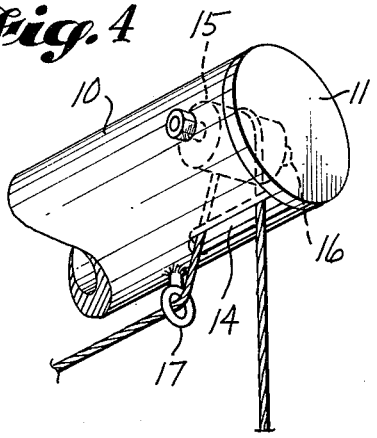
FIG. 4 is an enlarged, fragmentary, bottom perspective of an upper portion of such device with parts broken away.

As shown in the drawings, the preferred soccer practice device in accordance with the present invention includes a portable base 1 of conical shape which preferably is of strong molded plastic material. The base is hollow so that it may be filled with sand, for example, through the hole normally closed by the plug 2. The upper end portion of the base forms a collar 3 into which the bottom end portion of a tubular bottom standard section 4 is fitted to maintain such section upright. A pin 5 extends through registered holes in the collar 3 and the bottom standard section 4 to prevent rotation of such section relative to the base.

Figure 3:
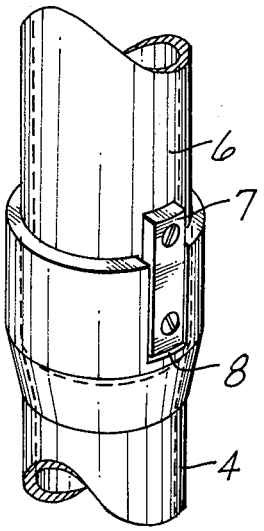
FIG. 3 is an enlarged, fragmentary, top perspective of a central portion of such device.
Figure 2:
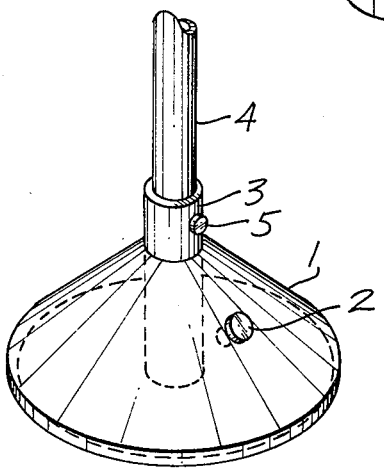
FIG. 2 is a fragmentary, top perspective of the bottom end portion of the device of FIG. 1.

The upper end portion of the bottom standard section 4 is of increased diameter for snugly receiving the lower end portion of a middle standard section 6. As best seen in FIG. 3, to prevent relative rotation of the bottom and middle standard sections an upright key plate 7 is secured to the exterior of the bottom end portion of the middle standard section and fits in an upright keyway or slot 8 in the upper end portion of the bottom standard section. Preferably, the bottom of the key plate is flush with the bottom of the middle standard section and engages against the bottom of the keyway or slot 8 so that the middle standard section does not become wedged in the bottom standard section so as to make separation of the two sections difficult.

Similarly, the upper end portion of the middle standard section 6 is of increased diameter and snugly receives the lower end portion of a top standard section 9. The connection of the top standard section to the middle standard section is the same as the connection of the middle standard section to the bottom standard section. The lower end portion of the top standard section has an upright key plate 7 secured to its exterior which plate is fitted in an upright keyway or slot 8 in the upper end portion of the middle standard section. The upper end portion of the top standard section is bent horizontally outward to form a horizontal arm 10, the free end of which is closed by a cap 11.

Preferably, all of the standard sections are lightweight metal tubing such as aluminum alloy.

A soccer ball 12 is suspended from the outer end portion of the horizontal arm 10 by a flexible line 13 which can be a rope or a cable. From the soccer ball the line extends up through a slot 14 in the underside of the outer end portion of the horizontal arm, then around a pulley or roller 15 carried by a horizontal axle 16 which can be a bolt. From the roller the cord extends down, back out through the slot 14, and then through guide eyes 17 positioned, respectively, adjacent to the inner end of the slot, at the inside of the 90 degree bend of the top standard section 9, and at the upper end portion of the middle standard section 6. The free end portion of the line 13 is anchored to a cleat 18 mounted on the lower end portion of the middle standard section.

In use, the height of the soccer ball can be adjusted for an individual player by loosening the line from the cleat, hauling in or paying out the appropriate length of line and again anchoring the line to the cleat. For an inexperienced player, the ball would be positioned at about eye level and, since the ball will be stationary, the player can be instructed as to proper heading techniques and practice such techniques without fear of the ball striking the player's face, for example. As the player gains more confidence, the ball can be swung up to be headed by the player when the ball swings back down. For more experienced players, the ball can be positioned higher for practicing jumping to head the soccer ball or lower for practicing diving to head the ball.

The knockdown construction of the device allows it to be assembled and disassembled quickly and also allows it to be transported easily such as in the trunk of an automobile. Preferably, the height of the standard is at least about 11 feet (3.3 meters), in which case each standard section is about 3 to 4 feet (0.9 to 1.2 meters) long, so that the soccer ball always is suspended a substantial distance below the horizontal arm. The base can be about 2 to 3 feet (0.6 to 0.9 meter) in diameter and filled with sand to weigh about 60 to 80 pounds (27.22 to 36.29 kilograms) to support a tubular standard of a diameter of about 2 inches (50.8 millimeters) in stable fashion. The horizontal arm should be at least about 3 feet (0.9 meter) long so that a player will not contact the standard while practicing.

I claim:

1. A soccer practice device for use in practicing heading techniques comprising an elongated standard member formed of a plurality of elongated standard sections connectible end-to-end in aligned, nonrotative relationship, a portable base for receiving the lower portion of said standard member and for supporting said standard member in upright position, an elongated arm member cantilevered from the upper portion of said standard member so as to project generally horizontal when said standard member is in upright position, a soccer ball, a line having one end portion connected to said soccer ball, means carried by said members for guiding said line generally along the length of said arm member so as to suspend said soccer ball from the outer free end portion of said arm member at a height appropriate for practicing heading said soccer ball, and means carried by said standard member for attaching the free end portion of said line so as to maintain said soccer ball at such height and enabling adjustment of the height of the soccer ball.

2. A soccer practice device comprising an elongated standard member formed of a plurality of elongated tubular standard sections connectible generally end-to-end in generally aligned, nonrotative relationship, a portable base for receiving the lower portion of said standard member and for supporting said standard member in upright position, said base including connection means for deterring rotation of said standard member relative to said base, an elongated tubular arm cantilevered from the upper portion of said standard member so as to project generally horizontal when said standard member is in upright position, said arm having a roller at generally the free end portion thereof and carried inside the bore of said arm, a soccer ball, a line having one end portion connected to said soccer ball and threaded over said roller, guide means carried by said arm for guiding said line generally along said arm, and a cleat carried by said standard member enabling the free end portion of said line to be anchored to said cleat for maintaining said soccer ball at a desired height selected for an individual player and appropriate for such player to practice heading the soccer ball.

3. A soccer practice device comprising a long and straight tubular bottom standard section, a long and straight tubular middle standard section of approximately the same length as said bottom standard section, a tubular top standard section having a first long and straight portion of approximately the same length as said bottom and middle standard sections and a second long and straight portion bent generally perpendicular to said first portion and of approximately the same length as said first portion, standard connection means for joining said standard sections generally end-to-end with said bottom standard section, said middle standard section and said first portion of said top standard section in generally coaxial relationship, said standard connection means including means for deterring relative rotation of said standard sections, a portable base, base-connection means for joning an end portion of said bottom standard section to said portable base and including means for deterring relative rotation of said bottom standard section and said base, a soccer ball, a line having one end portion connected to said soccer ball, means for guiding said line generally along said arm from generally the free end portion of said arm to generally the area of connection of said first and second portions of said arm, and anchor means carried by one of said standard sections for anchoring thereto the free end portion of said line.

* * * * *